United States Patent [19]

Myers

[11] 3,985,628

[45] Oct. 12, 1976

[54] POLLUTION CONTROL IN ELECTROPLATING SYSTEMS

[76] Inventor: Lyle R. Myers, 5227 Martin Road, Corunna, Mich. 48817

[22] Filed: Aug. 4, 1975

[21] Appl. No.: 601,466

[52] U.S. Cl. ..... 204/14 R; 204/237; 204/275; 204/278

[51] Int. Cl.[2] ..... C25D 3/00; C25D 21/04

[58] Field of Search.... 204/14 R, 23, 232, 237–240, 204/258, 270, 275, 278, 35 R

[56] References Cited

UNITED STATES PATENTS

| | | | |
|---|---|---|---|
| 3,485,743 | 12/1969 | Mayland et al. | 204/234 |
| 3,640,331 | 2/1972 | Yagishita | 204/237 |
| 3,661,732 | 5/1972 | Withrow | 204/232 |
| 3,761,381 | 9/1973 | Yagishita | 204/237 |

*Primary Examiner*—T. M. Tufariello
*Attorney, Agent, or Firm*—Gifford, Chandler & Sheridan

[57] ABSTRACT

Air above an electroplating bath is scrubbed with the plating rinse water to effect the transfer of chemical values from the air to the rinse water and to effect transfer of water to the air. The chemically enriched rinse water is added to the plating bath. In the system the waste heat generated in the plating bath is the only heat used in water removal, substantially no water is circulated from the plating bath, water added to the rinse is restricted by using a relatively high pressure-low volume spray rinse, and substantially no auxiliary air is used in addition to that required to sweep over the plating baths.

10 Claims, 2 Drawing Figures

POLLUTION CONTROL IN ELECTROPLATING SYSTEMS

BACKGROUND OF THE INVENTION

In recent years the electroplating industry has been paying increasing attention to the discharge of undesirable elements into the environment. Pollution of streams by discharge of rinse water and air pollution by discharge of fumes from hot electroplating baths have been of particular concern. Such loss of pollutants from a plating plant also has a direct bearing on the economics of plant operation because the pollutants include chemical values the loss of which must be made up by additions to the plating tank.

A traditional way of handling the pollution problem has been to use relatively large quantities of water to dilute the pollutant. This adds to the economic problem and has doubtful value in pollution control. Recently the art has turned in the direction of what appears to be the only logical solution to the problem; that is, to make the plating operation as nearly as possible a closed ecological system.

An attempt toward a closed system is described, by way of example, by Withrow in U.S. Pat. No. 3,661,732. The latter patent describes by way of example, (a) the removal of 2000 gallons per minute of chromium bath liquid at 110° F., (b) the removal of 30 gallons per minute of rinse water at 150° F, (c) the joining of the two streams at 113° F, (d) their transfer to a reservoir at 110° F, (e) the heating of the liquid to 125° F, (f) the passing of the liquid downwardly through a packed column countercurrent to air (35,000 cubic feet per minute collected in fume hoods over the plating baths plus 30,000 cubic feet per minute of auxiliary air), (g) wherein the air removes water from the liquid stream, and (h) wherein the liquid stream removes chemical values from the air. The resulting liquid stream, with less water and increased chemical values, is returned to the chromium plating bath.

It is the object of this invention to use such a closed system but in a much improved manner requiring (a) no added heat other than the waste heat generated in the plating baths, (b) much less added water in the rinse and (c) circulation of the heating of only a relatively small percentage of liquid for purposes of the water-chemical value interchange in the air scrubbing step.

It is a specific object of the invention to provide a preferred embodiment in which (a) the waste heat generated in the plating bath is the only heat used in water removal, (b) no water is circulated from the plating bath, (c) water added to the rinse is restricted by using a relatively low volume-relatively high pressure spray rinse, and (d) no auxiliary air is needed other than that required to sweep over the plating baths.

SUMMARY OF THE INVENTION

The invention involves an electroplating process wherein the heat generated in the electroplating bath is in excess of that required to maintain the temperature of the bath, and, more particularly, the treatment of rinse water and fumes is in a manner to maintain a water balance, heat balance, and chemical value balance in a manner to effect a valuable contribution to both the ecological and economic aspects of the electroplating art.

In the process, fumes above the bath are swept with air to a scrubber. Rinse water, to which excess heat from the bath has been added, is contacted with the air stream in a scrubber to effect the transfer of chemical values from the air to the rinse water and to effect transfer of water and heat from the scrubber liquid to the air. The substantially water-saturated air leaves the system and the relatively cooler and more concentrated scrubber water is added to the electroplating bath.

I have found that the air-water-heat-chemical balance in such a system does not require the addition of heat other than that generated in excess of the heat required to maintain the desired temperature of the plating bath, does not require any auxiliary air in addition to that required to sweep the fumes from above the bath to the scrubber, and does not require the amounts of rinse water heretofore commonly used in the industry.

Thus the invention provides for:

a. limiting the scrubbing liquid substantially to rinse water;

b. limiting the air flow to substantially that required to sweep the fumes from above the plating bath to the scrubber;

c. limiting the heat added to the scrubbing liquid to the excess heat from the plating bath; and d. bringing the system into balance by limiting the volume of water used in the rinse to that required to substantially saturate the air moving through the scrubber, said limiting of water being preferably effected by adjusting the pressure of the rinse spray. Thus, by way of example, if the air is not removing enough water in the scrubber under the air-water-temperature conditions then extant, the water added via the spray rinse is reduced in volume and increased in pressure. In this manner the system is brought into balance without sacrifice of rinse quality.

DETAILED DESCRIPTION

Figure 1:
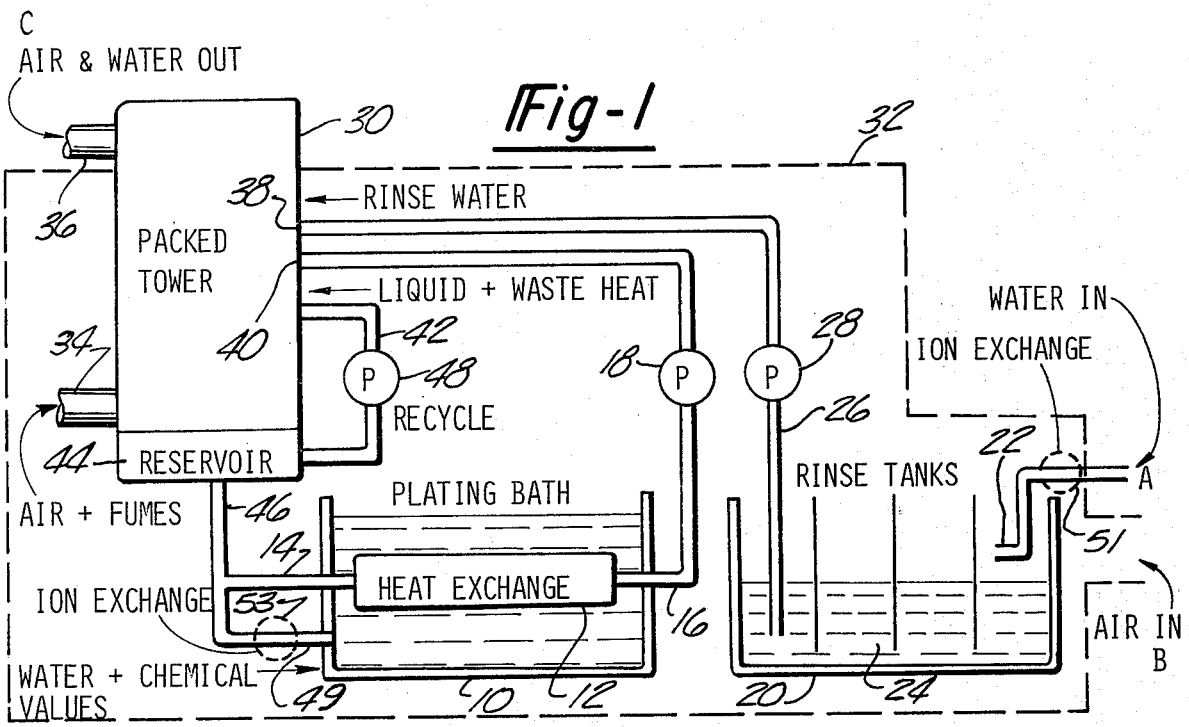
FIG. 1 is a generalized schematic view illustrating the invention.

Referring to FIG. 1 of the drawings, a plating tank 10, which may be a chromium plating tank by way of example, is provided with a heat exchange unit 12. The heat exchange unit 12 is provided with inlet pipe 14 and exit pipe 16, the latter provided with pump 18.

A rinse tank 20 is provided with an inlet water spray nozzle 22 where the plated part is given a final spray rinse under pressure, and a plurality of rinsing zones, such as zone 24, wherein the plated part can be rinsed by dipping, the movement of the plated part being countercurrent to the flow of rinse water. Rinse tank 20 is provided with an outlet pipe 26 provided with pump 28.

A packed tower 30, which may be vertically packed or horizontally packed, is provided with an air inlet 34, an air outlet 36, a rinse water inlet 38, an inlet 40 for heated liquid from heat exchanger 12, a recycle conduit 42, a reservoir 44, and bottom liquid outlet 46. The recycle conduit 42 is provided with pump 48. Bottom outlet conduit 46 communicates with heat exchange inlet 14 and plating tank inlet 49.

Ion exchange units, such as unit 51 for inlet water and unit 53 for water added to the plating bath, may be inserted into the system where desired. Similarly, valves and additional pumps may be added as desired in accordance with well known engineering principles.

The phantom line 32 symbolically encloses the system under consideration to which water is added (arrow A) via nozzle 22, to which air is added (arrow B) to sweep over the tank 10, and from which air and water are removed (arrow C) from the packed tower 30.

Figure 2:
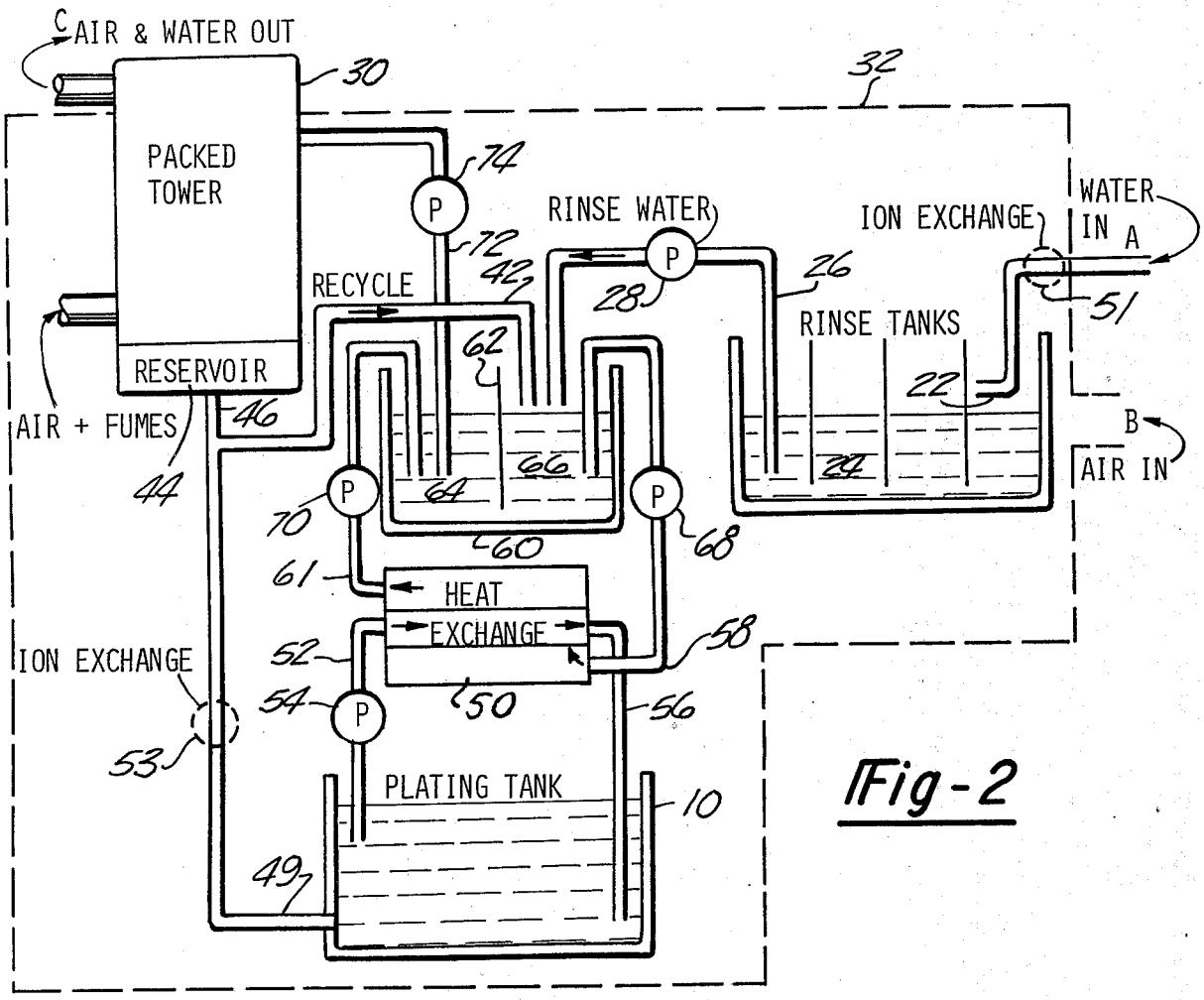
FIG. 2 is a schematic view illustrating a preferred embodiment of the invention.

In the schematic of FIG. 1, and for purposes of clarity, separate conduits to the scrubber tower 30 are shown for each of the inlet liquids; rinse water 38, recycle liquid 42, heat exchange liquid 40. However, these conduits can be combined with advantage in many configurations. FIG. 2 represents one such configuration wherein special advantage is gained.

In FIG. 2, heat exchanger 50 is positioned outside the plating bath 10. Heat exchanger 50 is provided with inlet conduit 52 provided with pump 54 to circulate hot liquid from the electroplating bath 10 and with exit conduit 56 to return cool liquid to the plating bath. Heat exchanger 50 is also provided with an inlet 58 for liquid to be heated and outlet 60 for the so heated liquid.

A collection tank 61 is provided with a partition 62 which divides the tank 60 into a chamber 64 and a chamber 66. Chamber 66 receives rinse water from conduit 26 and recycle liquid from conduit 42. Liquid is removed from chamber 66 via conduit 58 and pump 68 and enters the heat exchanger 50.

Chamber 64 receives the relatively hot liquid from the heat exchanger via pump 70 and conduit 61. Liquid is removed from chamber 64 via conduit 72 and pump 74 and enters the top of tower 30.

Collection tanks, such as tank 60, are preferred, by way of example, when the temperature of the rinse water is higher than the temperature of the plating bath. In this manner; that is, by premixing the heat exchange water, the reservoir (44) water and rinse water; the waste heat from the bath can be added to the scrubber water.

OPERATION

Referring to FIG. 1, a basis metal (not shown) is plated in plating tank 10 which is maintained at an elevated temperature. For example, a chromium bath at 115° F., a matrix or bright nickel bath at 135° F., a zinc cyanide barrel plating bath at 95° F., a cyanide cadmium barrel plating bath at 95° F., and a cyanide copper bath at 145° F. would be typical examples of bath plating temperatures. These baths are characterized by the fact that their electrical resistivity is such that more heat is produced by the plating current than is required to maintain the desired plating temperature. This excess heat is referred to as waste heat, excess heat, or the like.

When plating has been completed the plated metal is rinsed in the usual manner such as by immersing it first in a succession of baths, such as bath 24, which receive water from the spray rinse zone. The plated metal is then given a final rinse under pressure by water from spray nozzle 22 which is the sole point of entry of water into the system.

Rinse water from one or more rinse tanks with similar contaminants is then conducted to the scrubber either directly or via a collection tank such as tank 60. Although the invention contemplates that substantially all scrubber water is derived from rinse water relatively smaller amounts of contaminated water, such as overflow spillage from the plating bath, may be added to the scrubber water without any significant change in water balance.

Meanwhile fumes from above the plating bath, or group of similar baths, are swept by air to the scrubber where the air and scrubber water are usually passed countercurrent to each other, and usually in a vertically or horizontally packed tower. The warm air becomes substantially saturated with water and the exiting scrubber water dissolves substantially all the chemical values from the air. The exiting scrubber water is added to the plating bath or, in part, is recycled where necessary for water balance.

The system is working perfectly when the quantity of water removed in the scrubber is substantially equal to the quantity added to the spray rinse. I have found that this relationship can be maintained by controlling the volume-pressure relationship of the spray water. Where, for example, the rising is satisfactory but water is accumulating in the system, the spray pressure is increased and the spray water volume is decreased to maintain rinsing quality and to secure water balance. Where water is being lost from the system the spray pressure is reduced and spray water volume is increased.

I have found that in the use of the process of my invention that water usage can be reduced as much as 80 percent and chemical usage can be reduced by 40–80 percent as compared to presently used methods. Generally, reduction in chemical usuage in chromium plating of 60–70 percent can be expected, reductions in zinc and cadmium of 40 percent can be expected, and reductions in cyanide copper, acid copper, and nickel of 40–60 percent can be expected.

I claim:

1. In an electroplating process wherein the heat generated is in excess of that required to maintain the temperature of the electroplating bath, wherein the electroplate is rinsed with water, wherein fumes above said bath are swept with air to a scrubber to contact process liquid flowing through said scrubber in a manner to transfer water from said scrubber liquid to said air and to transfer chemical values from said air to said scrubber liquid, to produce a substantially water-saturated air and a concentrated liquid with enhanced chemical values, the improvement which comprises:

a. limiting said scrubber liquid substantially to rinse water;
b. limiting said air flow substantially to that required to sweep said fumes from above said bath to said scrubber;
c. limiting the heat added to said scrubber liquid to said excess heat from said electroplating bath; and
d. limiting the volume of water used in said rinse to that required to substantially saturate said air moving through said scrubber.

2. The method as defined in claim 1 wherein the volume of water required in the spray rinse is controlled by varying the pressure of said spray.

3. The method as defined in claim 1 wherein said process liquid is augmented by overflow liquid from the plating bath.

4. The method as defined in claim 1 wherein said scrubber is a vertical packed tower wherein said air moves upwardly countercurrently to said process liquid.

5. The method as defined in claim 1 wherein a portion of said concentrated liquid is recycled for further contact with said air.

6. The method as defined in claim 1 wherein said tower is a horizontally packed tower.

7. The method as defined in claim 1 wherein at least a portion of said concentrated liquid is added to said electroplating bath.

8. The method as defined in claim 7 wherein substantially all of said concentrated liquid is added to said bath.

9. The method as defined in claim 1 wherein heat exchange is effected to transfer heat from said electroplating bath to said scrubber liquid.

10. The method as defined in claim 1 wherein the volume of liquid required in the spray is controlled by varying the pressure of said spray, wherein heat exchange is effected to transfer heat from said bath to said scrubber liquid, and wherein substantially all of said concentrated liquid is added to said bath.

* * * * *

UNITED STATES PATENT AND TRADEMARK OFFICE

CERTIFICATE OF CORRECTION

PATENT NO. : 3,985,628

DATED : Oct. 12, 1976

INVENTOR(S) : LYLE R. MYERS

It is certified that error appears in the above-identified patent and that said Letters Patent are hereby corrected as shown below:

Col. 1, line 47, delete "the"
and insert --and--

Col. 3, line 27, delete "60"
and insert --61--

Signed and Sealed this

First Day of February 1977

[SEAL]

*Attest:*

RUTH C. MASON
*Attesting Officer*

C. MARSHALL DANN
*Commissioner of Patents and Trademarks*